United States Patent [19]

Staib

[11] Patent Number: 4,469,513

[45] Date of Patent: Sep. 4, 1984

[54] MOLTEN COPPER OXYGENATION

[75] Inventor: William G. Staib, Carrollton, Ga.

[73] Assignee: Southwire Company, Carrollton, Ga.

[21] Appl. No.: 510,091

[22] Filed: Jul. 1, 1983

[51] Int. Cl.[3] ..... C22B 15/00

[52] U.S. Cl. ..... 75/76; 75/59

[58] Field of Search ..... 75/76, 59

[56] References Cited

U.S. PATENT DOCUMENTS 3,598,383 8/1971 Moore ..... 75/53

4,073,646 2/1978 Kryczun ..... 75/76

*Primary Examiner*—Peter D. Rosenberg

*Attorney, Agent, or Firm*—Herbert M. Hanegan; Robert S. Linne; Michael C. Smith

[57] ABSTRACT

In an in-line refining vessel (50) having one or more submerged porous plugs (20) for bubbling gasses through the molten metal (47) to stir the slag layer (46) covering same, an oxygen lance (40) for effectively oxygenating the melt from above. A plurality of such devices may be used in a single vessel.

9 Claims, 3 Drawing Figures

MOLTEN COPPER OXYGENATION

TECHNICAL FIELD

This invention relates to the metallurgical arts, and more particularly to copper refining metallurgy. Specifically, this invention relates to improvements in equipment for the oxygenation phase of in-line refining of copper metal.

BACKGROUND ART

Copper produced by smelting is frequently electrolytically refined. For this reason, the molten copper product must be suitable for casting anodes. This makes it necessary to refine the copper to remove substantial quantities of dissolved sulphur and oxygen in order to cast desirable anodes. If the metal were cast directly, the high level of sulphur (typically 0.05%) and dissolved oxygen (typically 0.5%) would combine to form $SO_2$ blisters in the cast metal. The purpose of in-line refining, as practiced with the present invention, is to remove sulphur from the molten copper. This is done in two steps: "blowing" and "poling". Blowing is the oxygenating step, wherein the sulphur is oxidized (to $SO_2$), lowering the sulphur level (to typically 0.003%) in the molten copper. Poling—introducing hydrocarbon into the melt—minimizes the formation of copper oxide during solidification.

The present invention is directed to improvements in apparatus for the oxidation of molten copper. In one process for in-line copper refining, molten copper is subjected to oxygenation during the refining process.

At first, experiments were attempted with an oxygen lance similar to those used in the steel industry. Insufficient oxygenation resulted, due at least in part to the slag layer on the surface of the molten copper. The lance was incapable of penetrating the slag layer.

Another method of oxygenating the copper is by passing a stream of oxygen through a porous plug into the molten metal as shown, for example, by U.S. Pat. No. 3,904,180; No. 3,917,242; No. 3,972,709 or No. 4,277,381. An experimental arrangement was undertaken to determine the feasibility of using a porous plug to bubble oxygen onto the molten metal, as the metal moved past the porous plug by gravity. Bubbling pure oxygen through the porous plug, the plug failed prematurely. Two failure modes were noted; in the first, the pure oxygen reacted with the hot steel case of the porous plug and the plug shell melted and failed. In the second failure mode, molten copper peneterated the porous plug, and, combined with the first failure mode, molten copper leaked from the apparatus. It was found, however, that the plug did not fail if oxygen and nitrogen were mixed and bubbled through a copper sheathed porous plug fed with copper piping. Unfortunately, insufficient oxygenation took place.

DISCLOSURE OF THE INVENTION

The present invention incorporates the modified copper sheathed porous plug and the use of a mixture of oxygen and nitrogen to stir the slag layer, during which stirring the oxygen lance is capable of effectively penetrating the slag layer. The result is a bubbling of the molten copper sufficient to displace the slag layer on top of the molten copper, while partially oxygenating the melt. With the slag layer dispersed, the oxygen lance is able to permeate the molten copper sufficiently to oxygenate it to the desired level.

For these and other reasons which may become apparent hereinafter, this invention therefore contemplates the use of an oxygen lance in combination with a less reactive gas passing through one or more porous plugs in oxygenation vessels forming a portion of an in-line copper refining process. The porous plugs are copper sheathed where contacted with oxygen in order to reduce or eliminate the oxygen-steel reaction.

An object of this invention is to extend the life of porous plugs in oxygenation vessels.

Another object of this invention is to avoid premature plugging of such porous plugs, as by molten copper penetration.

Yet another object of the present invention is to eliminate oxygenation vessel downtime and maintenance expenses due to the need for frequent porous plug replacement.

And another object of the invention is the effective oxygenation of molten copper through the use of an oxygen lance for injecting oxygen into the molten copper.

BRIEF DESCRIPTION OF THE DRAWINGS

Other features and advantages of the invention disclosed herein will be apparent upon examination of the drawing figure forming a part hereof, in which the protective copper sheathed porous plug and oxygen lance apparatus is shown in detail.

BEST MODE FOR CARRYING OUT THE INVENTION

Figure 1:
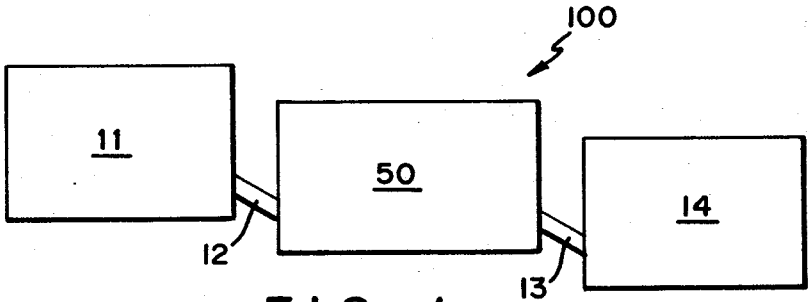
FIG. 1 shows the location of the oxygenation vessel in its in-line refining operation.

The present invention comprises improvements in an oxygenation vessel forming a part of an in-line refining operation 100, FIG. 1. The oxygenation vessel 50 is located along the in-line refining molten metal flow path between the furnace 11 and the reduction vessel 14. A first launder 12 conveys the molten metal to the oxygenation vessel 50, and a second launder 13 conveys the molten metal from the oxygenation vessel to the reduction vessel 14.

Figure 2:
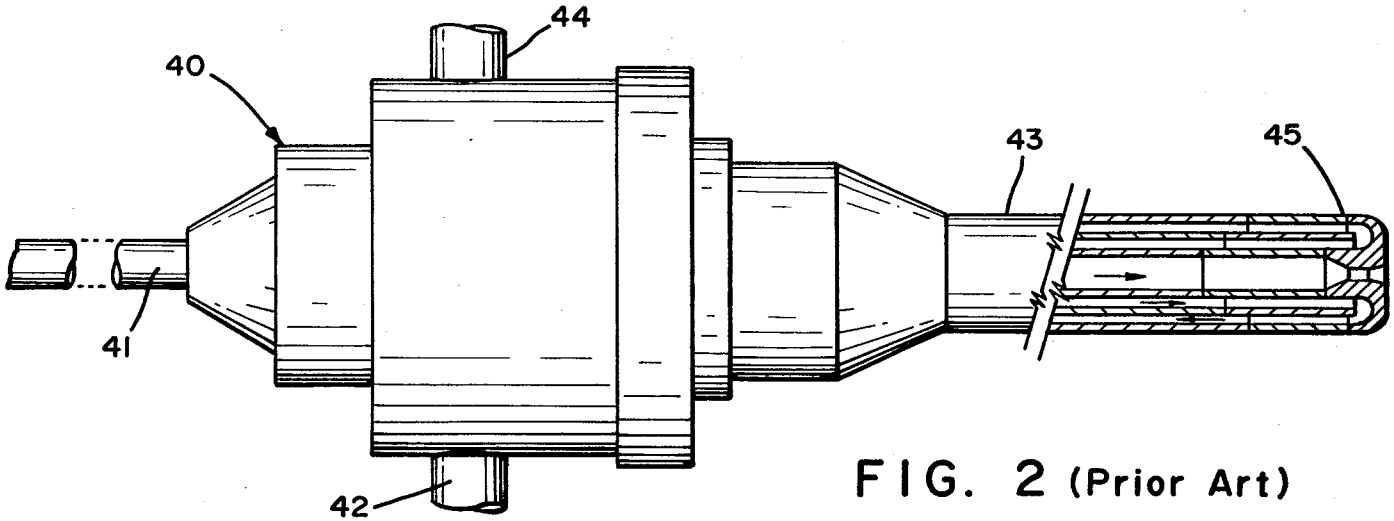
FIG. 2 (Prior Art)
FIG. 2 shows the oxygen lance including a partial cross section thereof.

FIG. 2 shows a conventional oxygen lace 40 as known in the steel industry. Lance tip 45 is directed to the molten copper 47 covered by slag layer 46. Oxygen is supplied to the lance means 40 via pipe 41; water, for cooling, is provided by pipe 44 and directed through the lance shaft 43 to lance tip 45, the exhausted via pipe 42.

Figure 3:
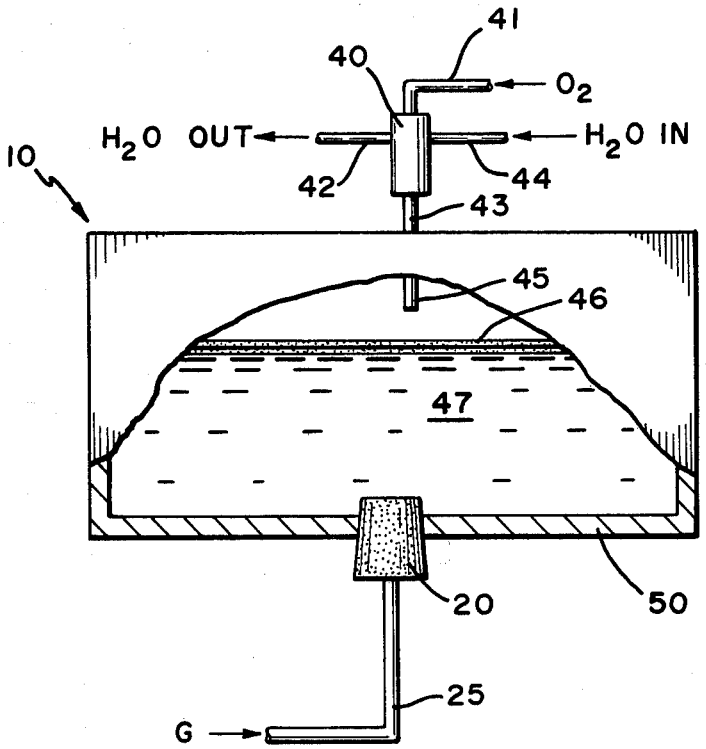
FIG. 3 shows the oxygenation vessel with portions removed to permit showing the porous plug and the oxygen lance of the invention.

Turning now to FIG. 3, there is shown a cutaway view of the oxygenation vessel 50 revealing the present invention 10. A series of one or more molten copper impervious porous plugs 20 are attached to the bottom of the oxygenating vessel 50. Porous plug 20 is supplied with a gas mixture G (which may be oxygen or air mixed with other gasses, such as nitrogen) via supply pipe 25. The gas G flow through pipe 25 to porous plug 20 may be controlled by a valve (not shown). Porous plug 20 may be covered for protection until needed.

What is claimed is:

1. The improved method of oxygenation of molten smelter copper containing slag and impurities of the type in which a gas is bubbled through the molten copper by means of a submerged porous plug, wherein the improvement is the combination of steps comprising:

a. flowing a continuous stream of molten smelter copper into, through, and out of an oxygenation vessel, said vessel having both porous plug means for bubbling a gas through the molten copper and having surface lance means for injecting a gas onto the surface of the melt; and slowing the flow of molten copper within the vessel and allowing impurities to separate thereby forming a slag layer on the surface of the melt; then b. while the melt temporarily resides in said vessel, removing the covering slag therefrom with at least one porous plug means by passing a gas under pressure through said porous plug means to stir the melt and push aside the slag covering thereby exposing the surface of the molten copper, and at the same time c. injecting oxygen onto the exposed surface and into the melt with said oxygen lance means thereby further oxygenating said melt and forming more slag.

2. The method of claim 1, wherein the gas passed through the porous plug in step b is oxygen.

3. The method of claim 1, wherein the gas passed through the porous plug in step b is inert.

4. The method of claim 1, wherein the gas passed through the porous plug in step b is dry ambient air.

5. The method of claim 1 wherein the gas passed through the porous plug in step b is a mixture of an inert gas and oxygen.

6. The method of claim 1 wherein the gas passed through the porous plug in step b is a mixture of an inert gas and dry ambient air.

7. The method of claim 1 wherein the gas passed through the porous plug in step b is nitrogen.

8. the method of claim 1 wherein the gas passed through the porous plug in step b is a mixture of nitrogen and oxygen.

9. The method of claim 1 wherein the gas passed through the porous plug in step b is a mixture of nitrogen and dry ambient air.

* * * * *

UNITED STATES PATENT AND TRADEMARK OFFICE

Certificate

Patent No. 4,469,513 Patented September 4, 1984

William G. Staib

Application having been made by William G. Staib, the inventor named in the patent above identified, Southwire Co., the assignee, for the issuance of a certificate under the provisions of Title 35, Section 256, of the United States Code, adding the name of Uday K. Sinha as a joint inventor, and a showing and proof of facts satisfying the requirements of the said section having been submitted, it is this 21st day of May, 1985, certified that the name of the said Uday K. Sinha is hereby added to the said patent as a joint inventor with the said William G. Staib.

Fred W. Sherling,
*Associate Solicitor.*